US010878740B2

(12) United States Patent
Kim et al.

(10) Patent No.: US 10,878,740 B2
(45) Date of Patent: Dec. 29, 2020

(54) METHOD OF GENERATING CORRECTION DATA FOR DISPLAY DEVICE, AND DISPLAY DEVICE STORING CORRECTION DATA

(71) Applicant: Samsung Display Co., LTD., Yongin-si (KR)

(72) Inventors: Mingyu Kim, Hwaseong-si (KR); Juneyoung Lee, Seoul (KR); Hyungwoo Yim, Hwaseong-si (KR); Hoi Sik Moon, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/577,757

(22) Filed: Sep. 20, 2019

(65) Prior Publication Data

US 2020/0098303 A1 Mar. 26, 2020

(30) Foreign Application Priority Data

Sep. 21, 2018 (KR) ..... 10-2018-0113825

(51) Int. Cl.
*G09G 3/20* (2006.01)

(52) U.S. Cl.
CPC ..... *G09G 3/2044* (2013.01); *G09G 2310/027* (2013.01); *G09G 2320/0233* (2013.01)

(58) Field of Classification Search
CPC ..... G09G 2310/027; G09G 2320/0233; G09G 2320/0285; G09G 2320/0693; G09G 3/2044; G09G 3/3208; G09G 3/3614
See application file for complete search history.

(56) References Cited

U.S. PATENT DOCUMENTS

2005/0151883 A1* 7/2005 Arai ..... G09G 3/20 348/572
2014/0247289 A1* 9/2014 Park ..... G09G 3/2055 345/690

(Continued)

FOREIGN PATENT DOCUMENTS

KR 10-0501299 B1 11/2003
KR 10-2015-0030013 3/2015

*Primary Examiner* — Hong Zhou
(74) *Attorney, Agent, or Firm* — Lewis Roca Rothgerber Christie LLP

(57) ABSTRACT

In a method of generating correction data for a display device, an image is captured, a plurality of correction values are obtained at a plurality of sampling positions based on the captured image, whether a frequency criterion about a total number of overflow correction values is satisfied is determined, the overflow correction values being the correction values outside at least one reference range whether an adjacency criterion about a number of the overflow correction values at sampling positions adjacent to a sampling position of the each of the overflow correction values is satisfied is determined, a bit shift operation is selectively performed on the plurality of correction values according to whether the frequency and/or adjacency criterion is satisfied, and correction data representing the plurality of correction values on which the bit shift operation is performed, and bit shift information about the bit shift operation are stored in the display device.

20 Claims, 14 Drawing Sheets
(3 of 14 Drawing Sheet(s) Filed in Color)

(56) References Cited

U.S. PATENT DOCUMENTS

| | | | | |
|---|---|---|---|---|
| 2015/0070403 | A1* | 3/2015 | Kim | G09G 3/3607 345/690 |
| 2015/0206276 | A1* | 7/2015 | Jung | G09G 5/00 345/561 |
| 2015/0287350 | A1* | 10/2015 | Jun | G09G 3/006 345/690 |
| 2016/0163252 | A1* | 6/2016 | Sugiyama | G09G 3/006 345/589 |
| 2016/0171939 | A1* | 6/2016 | Na | G09G 3/2003 345/690 |
| 2017/0169758 | A1* | 6/2017 | Park | G09G 3/3233 |
| 2019/0385571 | A1* | 12/2019 | Nagasawa | G09G 5/00 |

* cited by examiner

FIG. 8

| SHIFT BIT NUMBER | BIT SHIFT INORMATION |
|---|---|
| 0 | 00 |
| 1 | 01 |
| 2 | 10 |
| 3 | 11 |

METHOD OF GENERATING CORRECTION DATA FOR DISPLAY DEVICE, AND DISPLAY DEVICE STORING CORRECTION DATA

CROSS-REFERENCE TO RELATED APPLICATION(S)

This application claims priority to and the benefit of Korean Patent Application No. 10-2018-0113825 filed on Sep. 21, 2018 in the Korean Intellectual Property Office (KIPO), the entire content of which is incorporated herein in its entirety by reference.

BACKGROUND

1. Field

Embodiments of the present invention relate to display devices, and more particularly to methods of generating correction data for display devices, and display devices storing correction data.

2. Description of the Related Art

Even if a plurality of pixels included in a display device are manufactured by the same process, the plurality of pixels may have different luminances due to a process variation, or the like, and thus a mura defect may occur in the display device. To reduce or eliminate the mura defect, and to improve luminance uniformity of the display device, an image displayed by the display device in a module state may be captured, correction data may be generated based on the captured image, and the correction data may be stored in the display device. The display device may correct image data based on the stored correction data, and may display an image based on the corrected image data, thereby displaying the image with uniform luminance and without the mura defect.

However, because each correction data has the limited (and constant) number of bits, the correction data can represent correction values in a limited range. Accordingly, even if a correction value exceeding the limited range is required, the correction data representing the correction value exceeding the limited range cannot be stored in a display device, and the display device cannot perform mura correction with the correction value exceeding the limited range.

SUMMARY

Aspects of some example embodiments are directed toward a method of generating correction data for a display device capable of generating desired or optimal correction data.

Aspects of some example embodiments are directed toward a display device performing mura correction based on desired or optimal correction data.

According to example embodiments, there is provided a method of generating correction data for a display device. In the method, an image displayed by the display device is captured, a plurality of correction values are obtained at a plurality of sampling positions based on the captured image, it is determined whether a frequency criterion about a total number of overflow correction values is satisfied, the overflow correction values being the correction values outside at least one reference range, it is determined whether an adjacency criterion about a number of the overflow correction values at sampling positions adjacent to a sampling position of the each of the overflow correction values is satisfied with respect to each of the overflow correction values, a bit shift operation is selectively performed on the plurality of correction values according to at least one selected from whether the frequency criterion is satisfied or whether the adjacency criterion is satisfied, and correction data representing the plurality of correction values on which the bit shift operation is performed, and bit shift information about the bit shift operation are stored in the display device.

In example embodiments, when a ratio of the total number of the overflow correction values to a total number of the plurality of correction values is greater than or equal to a reference ratio, the frequency criterion may be determined to be satisfied.

In example embodiments, whether the frequency criterion is satisfied may be determined using an equation $$\text{“}\sum_{y=1}^{Vsize}\sum_{x=1}^{Hsize} H(F(x, y)) >= Vsize \times Hsize \times REF\ \%\text{”},$$

where F(x,y) represents the correction value at the sampling position having a horizontal direction coordinate of x and a vertical direction coordinate of y, H(F(x,y)) outputs a value of 1 when F(x,y) is outside the reference range and a value of 0 when F(x,y) is within the reference range, Vsize represents a vertical direction number of the plurality of sampling positions, Hsize represents a horizontal direction number of the plurality of sampling positions, and REF % represents a reference ratio.

In example embodiments, when the number of the overflow correction values at the sampling positions within an adjacent region to the sampling position of any one overflow correction value of the overflow correction values is greater than or equal to a reference adjacent number, the adjacency criterion may be determined to be satisfied.

In example embodiments, the adjacent region may include the sampling position of the any one overflow correction value, and the sampling positions located at top, bottom, right and left of the sampling position of the any one overflow correction value.

In example embodiments, whether the adjacency criterion is satisfied may be determined using an equation “H(F(x,y))+H(F(x,y))*H(F(x,y+1))+H(F(x,y))*H(F(x,y−1))+H(F(x,y))*H(F(x−1,y))+H(F(x,y))*H(F(x+1,y))>=3”, where F(x,y) represents the correction value at the sampling position having a horizontal direction coordinate of x and a vertical direction coordinate of y, and H(F(x,y)) outputs a value of 1 when F(x,y) is outside the reference range and a value of 0 when F(x,y) is within the reference range.

In example embodiments, the bit shift operation may be performed when the frequency criterion or the adjacency criterion is satisfied, and the bit shift operation may not be performed when all of the frequency criterion and the adjacency criterion are not satisfied.

In example embodiments, the at least one reference range may include a first reference range corresponding to a default integer portion bit number, a second reference range that is twice the first reference range, and a third reference range that is twice the second reference range. The bit shift operation may be performed with a shift bit number of 3 when the total number of the overflow correction values outside the third reference range is greater than or equal to a reference total number. The bit shift operation may be performed with a shift bit number of 2 when the total number of the overflow correction values outside the second reference range is greater than or equal to the reference total number and the total number of the overflow correction values outside the third reference range is less than the reference total number. The bit shift operation may be performed with a shift bit number of 1 when the total number of the overflow correction values outside the first reference range is greater than or equal to the reference total number and the total number of the overflow correction values outside the second reference range is less than the reference total number. The bit shift operation may not be performed when the total number of the overflow correction values outside the first reference range is less than the reference total number.

In example embodiments, the at least one reference range may include a first reference range corresponding to a default integer portion bit number, a second reference range that is twice the first reference range, and a third reference range that is twice the second reference range. The bit shift operation may be performed with a shift bit number of 3 when the number of the overflow correction values outside the third reference range at the sampling positions adjacent to the sampling position of the each of the overflow correction values is greater than or equal to a reference adjacent number. The bit shift operation may be performed with a shift bit number of 2 when the number of the overflow correction values outside the second reference range at the sampling positions adjacent to the sampling position of the each of the overflow correction values is greater than or equal to the reference adjacent number and the number of the overflow correction values outside the third reference range at the sampling positions adjacent to the sampling position of the each of the overflow correction values is less than a reference adjacent number. The bit shift operation may be performed with a shift bit number of 1 when the number of the overflow correction values outside the first reference range at the sampling positions adjacent to the sampling position of the each of the overflow correction values is greater than or equal to the reference adjacent number and the number of the overflow correction values outside the second reference range at the sampling positions adjacent to the sampling position of the each of the overflow correction values is less than the reference adjacent number. The bit shift operation may not be performed when the number of the overflow correction values outside the first reference range at the sampling positions adjacent to the sampling position of the each of the overflow correction values is less than the reference adjacent number.

In example embodiments, the bit shift information may represent a shift bit number of the bit shift operation.

In example embodiments, obtaining the plurality of correction values at the plurality of sampling positions, determining whether the frequency criterion is satisfied, determining whether the adjacency criterion is satisfied, and selectively performing the bit shift operation may be performed at each of a plurality of reference gray levels, and the correction data and the bit shift information may be stored at each of the plurality of reference gray levels.

According to example embodiments, there is provided a display device including a display panel including a plurality of pixels, a correction data memory configured to store correction data representing a plurality of correction values on which a bit shift operation is selectively performed according to at least one of whether a frequency criterion is satisfied and whether an adjacency criterion is satisfied, and bit shift information representing a shift bit number of the bit shift operation, a data corrector configured to determine an integer portion bit number and a decimal portion bit number of the correction data based on the bit shift information, to identify the plurality of correction values represented by the correction data based on the determined integer portion bit number and the determined decimal portion bit number, and to correct image data based on the identified plurality of correction values, a controller configured to output dithered image data by performing a dithering operation based on the corrected image data, and a data driver configured to generate data signals based on the dithered image data output from the controller, and to provide the data signals to the pixels.

In example embodiments, an image displayed by the display device may be captured, and the plurality of correction values may be obtained at a plurality of sampling positions based on the captured image. The frequency criterion may be determined to be satisfied when a ratio of a total number of overflow correction values to a total number of the plurality of correction values is greater than or equal to a reference ratio.

In example embodiments, the adjacency criterion may be determined to be satisfied when a number of the overflow correction values at sampling positions within an adjacent region to a sampling position of any one overflow correction value of the overflow correction values is greater than or equal to a reference adjacent number.

In example embodiments, the adjacent region may include the sampling position of the any one overflow correction value, and the sampling positions located at top, bottom, right and left of the sampling position of the any one overflow correction value.

In example embodiments, the frequency criterion is satisfied may be determined utilizing an equation $$\text{“}\sum_{y=1}^{Vsize}\sum_{x=1}^{Hsize} H(F(x,\ y)) >= Vsize \times Hsize \times REF\ \%\text{”},$$

where F(x,y) represents the correction value at a sampling position having a horizontal direction coordinate of x and a vertical direction coordinate of y, H(F(x,y)) outputs a value of 1 when F(x,y) is outside the reference range and a value of 0 when F(x,y) is within the reference range, Vsize represents a vertical direction number of a plurality of sampling positions, Hsize represents a horizontal direction number of the plurality of sampling positions, and REF % represents a reference ratio.

In example embodiments, whether the adjacency criterion is satisfied may be determined utilizing an equation “H(F(x,y))+H(F(x,y))*H(F(x,y+1))+H(F(x,y))*H(F(x,y−1))+H(F(x,y))*H(F(x−1,y))+H(F(x,y))*H(F(x+1,y))>=3”, where F(x,y) represents the correction value at a sampling position having a horizontal direction coordinate of x and a vertical direction coordinate of y, and H(F(x,y)) outputs a value of 1 when F(x,y) is outside the reference range and a value of 0 when F(x,y) is within the reference range.

In example embodiments, the correction data may represent the plurality of correction values at a plurality of sampling positions, and the data corrector may correct the image data for the each pixel of the plurality of pixels by performing a bilinear interpolation on the plurality of correction values at four sampling positions adjacent to each pixel of the plurality of pixels from among the plurality of sampling positions with respect to each pixel of the plurality of pixels.

In example embodiments, the correction data memory may store the correction data at each of a plurality of reference gray levels, and the data corrector may correct the image data for each pixel of the plurality of pixels by performing a linear interpolation on the plurality of correction values at two reference gray levels adjacent to a gray level of the image data for the each pixel of the plurality of pixels from among the plurality of reference gray levels with respect to each pixel.

In example embodiments, the controller may determine a dithering bit number of the dithering operation based on the shift bit number represented by the bit shift information, and may perform the dithering operation with the dithering bit number.

As described above, a method of generating correction data for a display device according to example embodiments may selectively perform a bit shift operation for a plurality of correction values according to at least one of whether a frequency criterion about the total number of overflow correction values is satisfied and whether an adjacency criterion about the number of adjacent overflow correction values is satisfied. Accordingly, undesired over-performance and/or non-performance of the bit shift operation may be prevented or reduced, and thus desired or optimal correction data suitable for each display device may be generated.

Further, the display device according to example embodiments may store correction data on which a bit shift operation is selectively performed according to at least one of whether a frequency criterion about the total number of overflow correction values is satisfied and whether an adjacency criterion about the number of adjacent overflow correction values is satisfied, and also store bit shift information about the bit shift operation, and may correct image data based on the correction data and the bit shift information. Accordingly, mura correction may be performed using desired or optimal correction data suitable for each display device.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Illustrative, non-limiting example embodiments will be more clearly understood from the following detailed description in conjunction with the accompanying drawings.

FIG. 8 is a diagram for describing an example of bit shift information.

DETAILED DESCRIPTION

Hereinafter, embodiments of the present inventive concept will be explained in detail with reference to the accompanying drawings.

Figure 1:
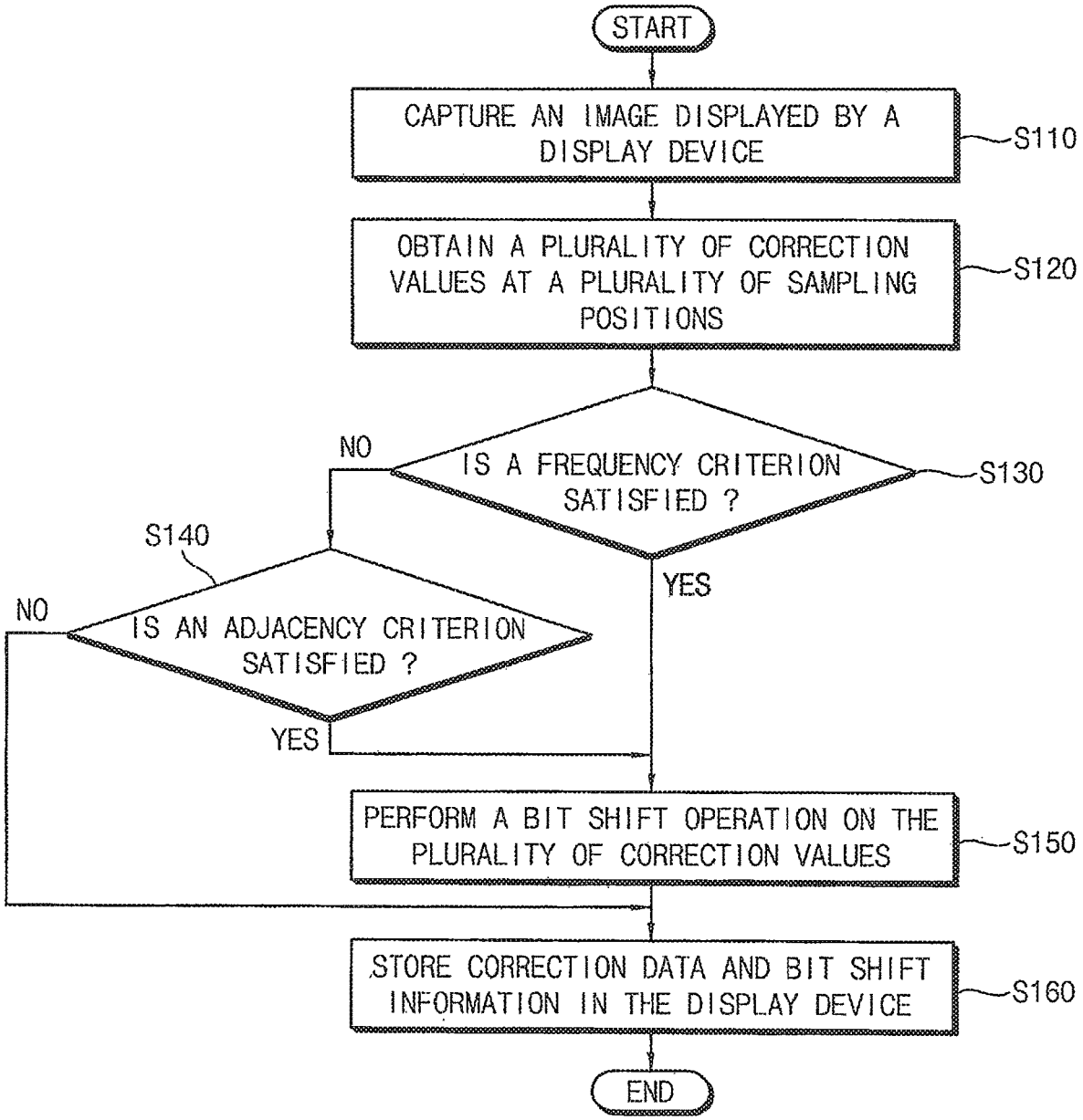
FIG. 1 is a flowchart illustrating a method of generating correction data for a display device according to example embodiments.
Figure 2:
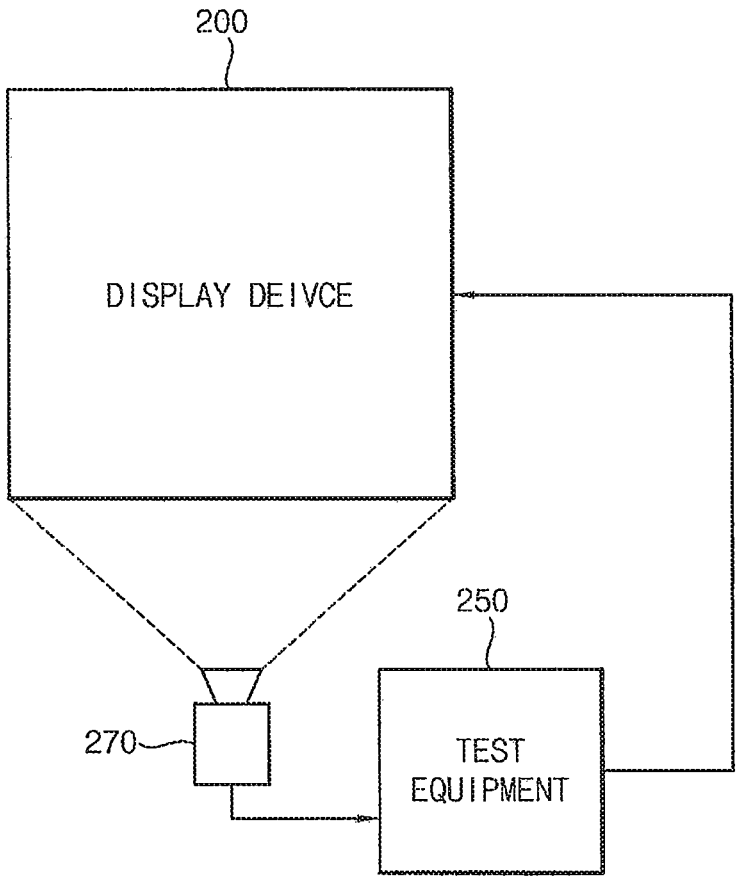
FIG. 2 is a block diagram illustrating an example of a test equipment performing a method of FIG. 1.
Figure 3:
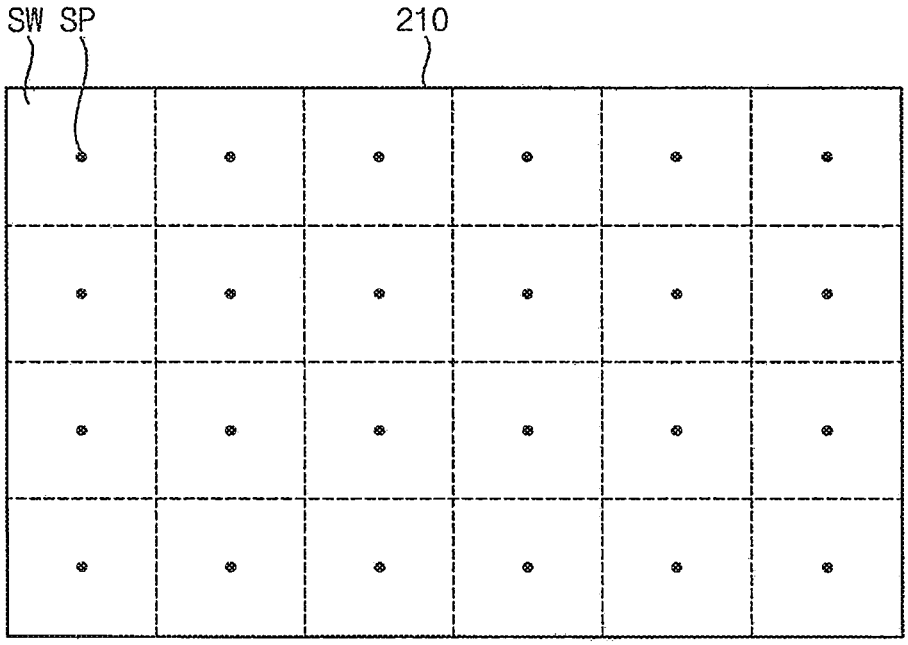
FIG. 3 is a diagram for describing an example of a plurality of sampling positions at which a plurality of correction values are obtained.
Figure 4:
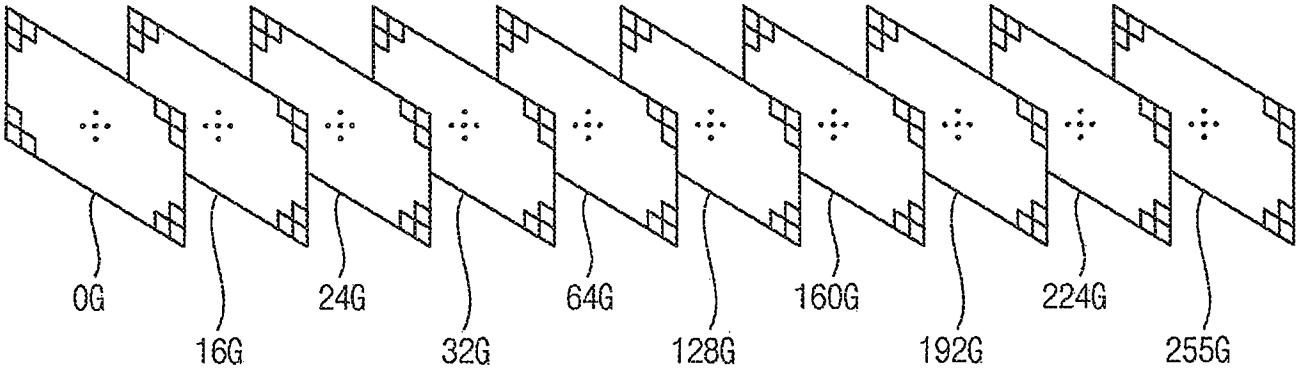
FIG. 4 is a diagram for describing an example of a plurality of reference gray levels at which a plurality of correction values are obtained.
Figure 5:
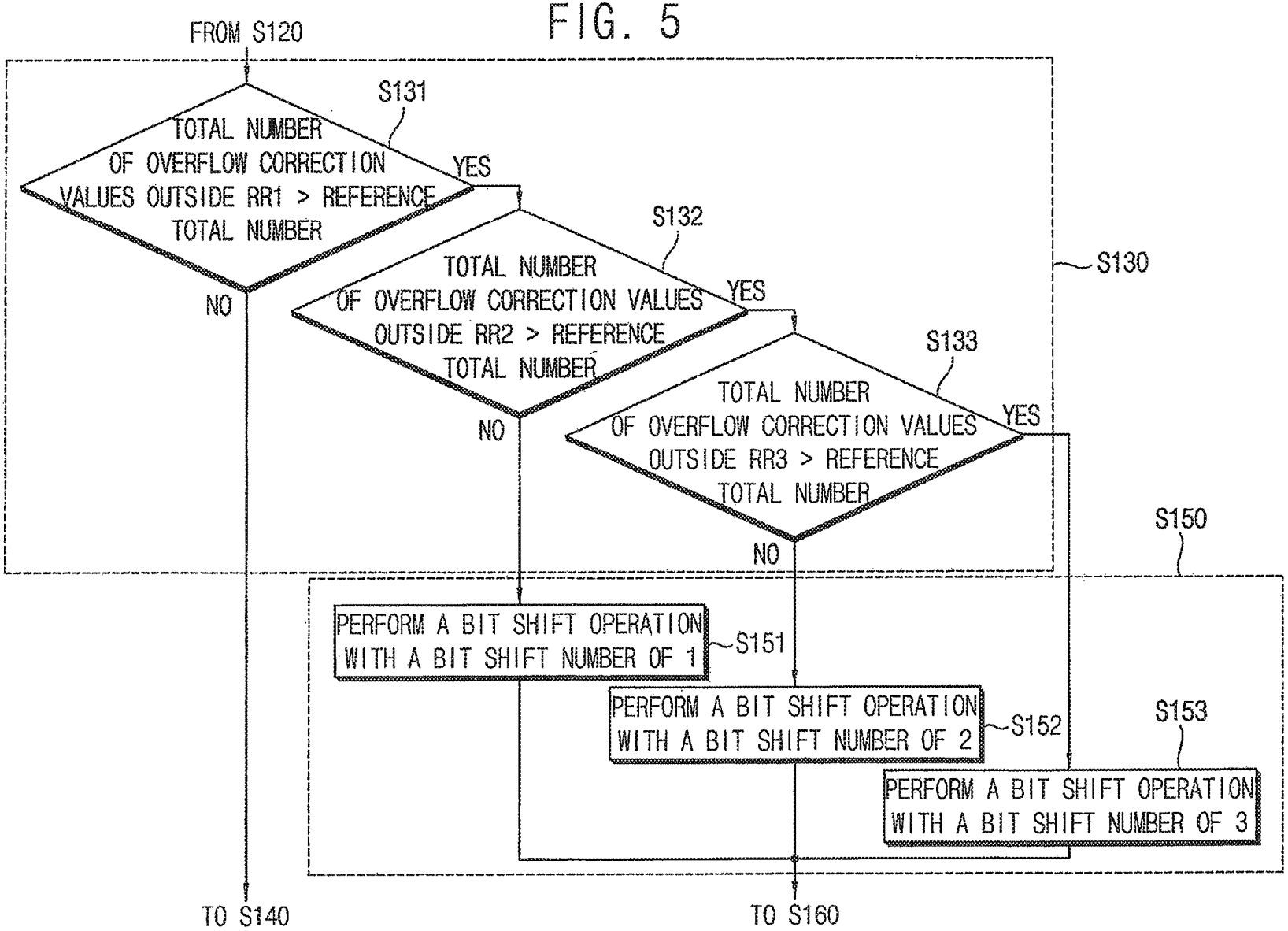
FIG. 5 is a flowchart for describing an example of an act of determining whether a frequency criterion is satisfied in a method of FIG. 1.
Figure 6:
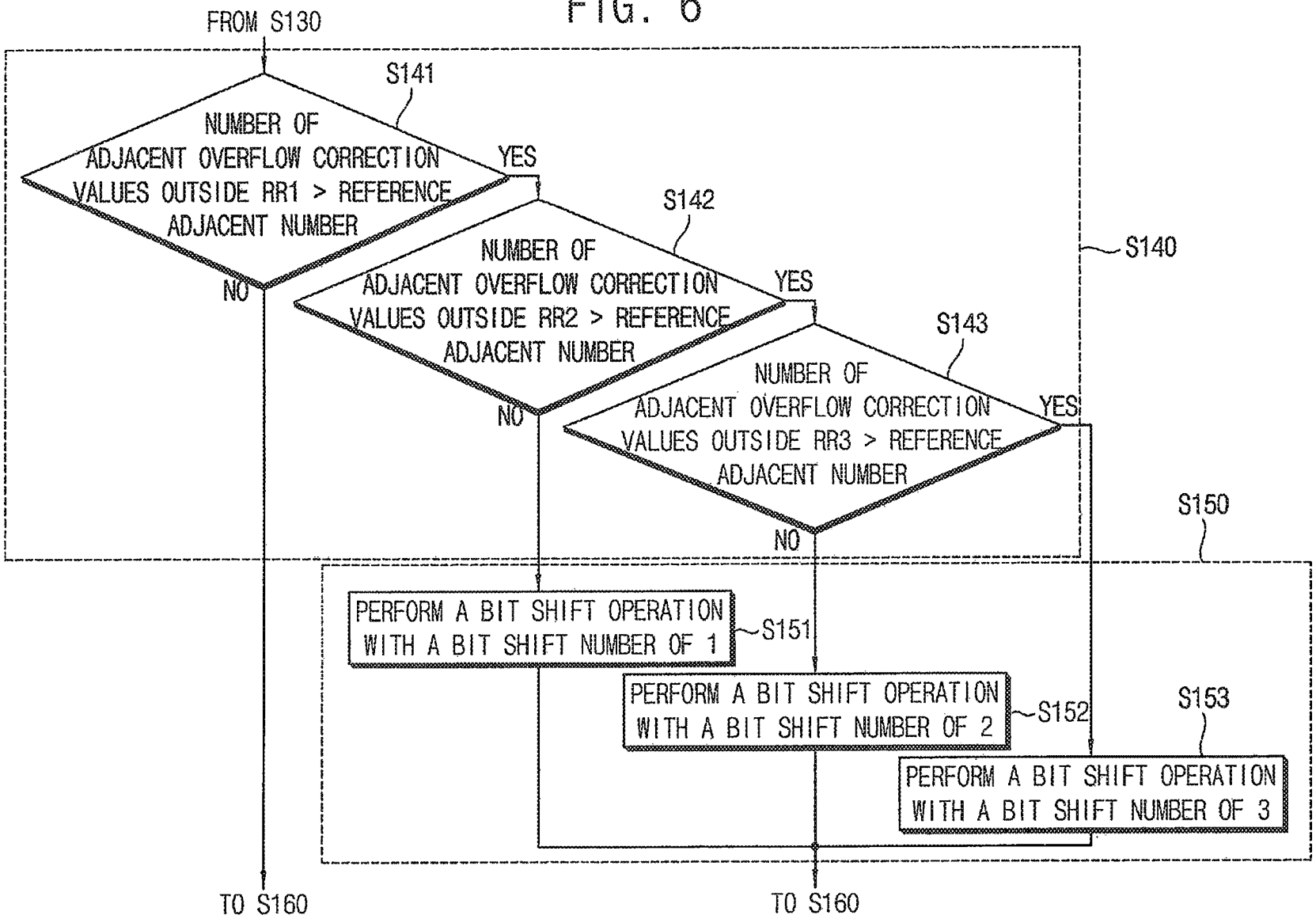
FIG. 6 is a flowchart for describing an example of an act of determining whether an adjacency criterion is satisfied in a method of FIG. 1.
Figure 7:
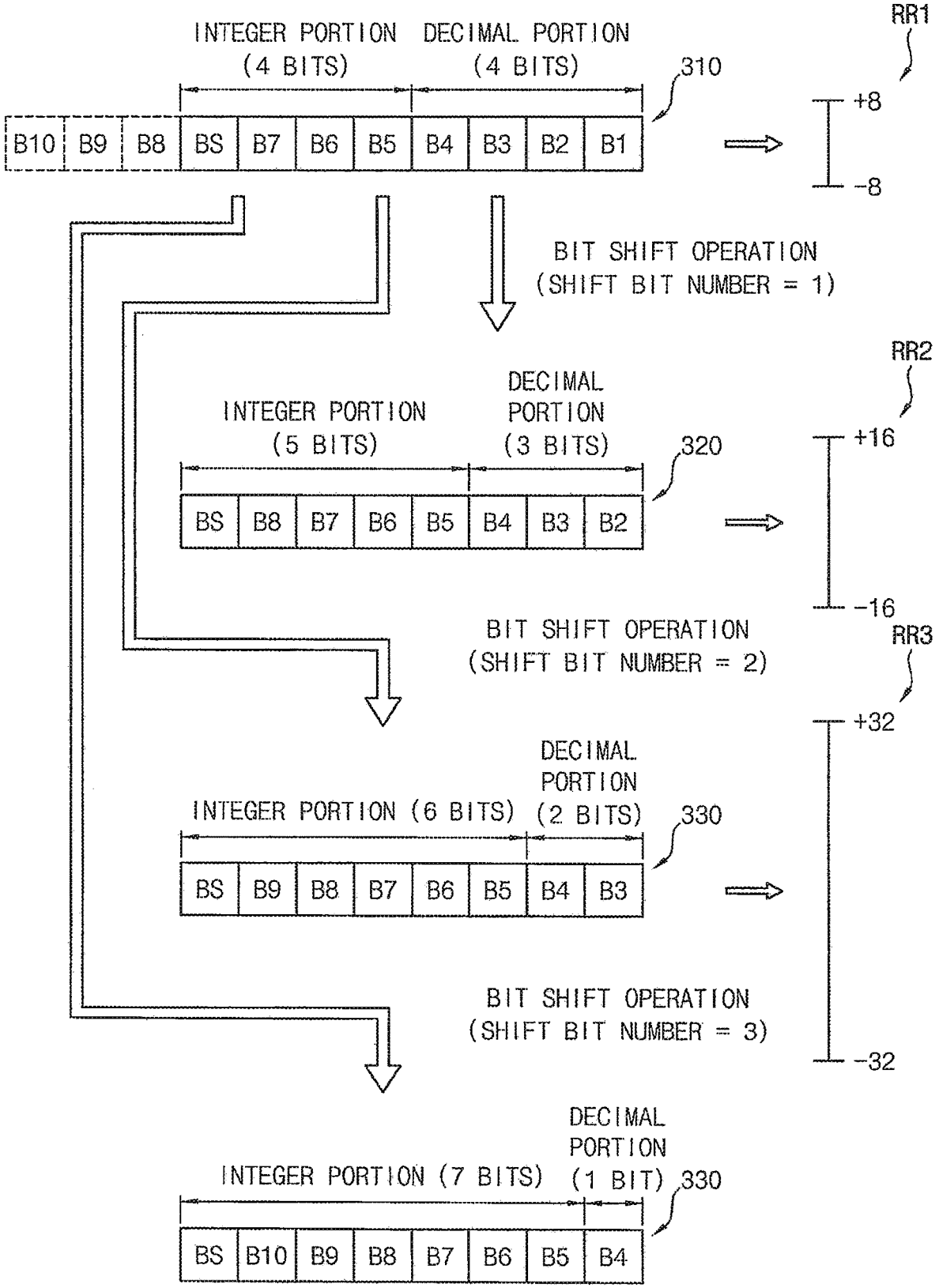
FIG. 7 is a diagram for describing examples of bit shift operations for correction values in a method of FIG. 1.

FIG. 1 is a flowchart illustrating a method of generating correction data for a display device according to example embodiments, FIG. 2 is a block diagram illustrating an example of a test equipment performing a method of FIG. 1, FIG. 3 is a diagram for describing an example of a plurality of sampling positions at which a plurality of correction values are obtained, FIG. 4 is a diagram for describing an example of a plurality of reference gray levels at which a plurality of correction values are obtained, FIG. 5 is a flowchart for describing an example of an act of determining whether a frequency criterion is satisfied in a method of FIG. 1, FIG. 6 is a flowchart for describing an example of an act of determining whether an adjacency criterion is satisfied in a method of FIG. 1, FIG. 7 is a diagram for describing examples of bit shift operations for correction values in a method of FIG. 1, and FIG. 8 is a diagram for describing an example of bit shift information.

Referring to FIGS. 1-2, a method of generating correction data for a display device 200 according to example embodiments may be performed by a test equipment 250 that performs an automatic test process (e.g., an automatic manual test (AMT) process). The test equipment 250 may provide test image data to the display device 200, and may capture an image displayed by the display device 200 based on the test image data by using a camera (e.g., a charge coupled device (CCD) camera) 270 (S110).

A plurality of correction values may be obtained based on the captured image (S120). For example, the plurality of correction values may be determined based on a difference between a luminance of the captured image and a target luminance. In some example embodiments, the plurality of correction values may be obtained at a plurality of sampling positions respectively corresponding to all pixels included in the display device 200. However, in this case, a size of correction data representing the plurality of correction values may be excessively increased. In other example embodiments, to protect from or prevent this excessive increase of the correction data size, a display panel of the display device 200 may be divided into a plurality of sampling windows each corresponding to two or more pixels, and the plurality of correction values may be obtained at one sampling position per each sampling window. For example, as illustrated in FIG. 3, the display panel 210 of the display device 200 may be divided into a plurality of sampling windows SW having substantially the same size, and the plurality of correction values may be obtained at the plurality of sampling positions SP respectively corresponding to the plurality of sampling windows SW. In an example, as illustrated in FIG. 3, each sampling position SP may be a center point of the corresponding sampling window SW. In other example, each sampling position SP may correspond to a top left pixel included in the corresponding sampling window SW. However, the sampling position SP may not be limited to the center point or the top left pixel of the sampling window SW.

Further, in some example embodiments, the plurality of correction values may be obtained at all gray levels (e.g., 256 gray levels from a 0-gray level to a 255-gray level). However, in this case, the size of correction data representing the plurality of correction values may be excessively increased. In other example embodiments, to protect from or prevent this excessive increase of the correction data size, the plurality of correction values may be obtained at one or more reference gray level corresponding to a portion of the all gray levels. For example, as illustrated in FIG. 4, the plurality of correction values may be obtained at ten reference gray levels, or 0-gray level 0G, 16-gray level 16G, 24-gray level 24G, 32-gray level 32G, 64-gray level 64G, 128-gray level 128G, 160-gray level 160G, 192-gray level 192G, 224-gray level 224G and 255-gray level 255G. However, the one or more reference gray level according to example embodiments may not be limited to the ten reference gray levels as illustrated in FIG. 4.

Whether a frequency criterion is satisfied and whether an adjacency criterion is satisfied may be determined based on the plurality of correction values, and a bit shift operation for the plurality of correction values may be selectively performed according to at least one of whether the frequency criterion is satisfied and whether the adjacency criterion is satisfied (S130, S140 and S150). Here, whether the frequency criterion is satisfied may be determined based on the total number of overflow correction values. The overflow correction values may be the correction values outside at least one reference range that is representable by each correction data having a limited bit number (at each reference gray level). Further, with respect to each overflow correction value, the adjacency criterion is satisfied may be determined based on the number of the overflow correction values (or the number of adjacent overflow correction values) at sampling positions adjacent to a sampling position of the each overflow correction value. In some example embodiments, as illustrated in FIG. 1, in a case where either the frequency criterion or the adjacency criterion is satisfied (S130: YES, or S130: NO and S140: YES), the bit shift operation may be performed on the plurality of correction values (S150). In a case where all of the frequency criterion and the adjacency criterion are not satisfied (S130: NO and S140: NO), the bit shift operation may not be performed.

In some example embodiments, when a ratio of the total number of the overflow correction values to the total number of the plurality of correction values is greater than or equal to a reference ratio, the frequency criterion may be determined to be satisfied (S130: YES). Further, when the ratio of the total number of the overflow correction values to the total number of the plurality of correction values is less than the reference ratio, the frequency criterion may be determined not to be satisfied (S130: NO). For example, whether the frequency criterion is satisfied may be determined using an equation $$\text{“}\sum_{y=1}^{Vsize}\sum_{x=1}^{Hsize} H(F(x,\ y)) >= Vsize \times Hsize \times REF\ \%\text{”},$$

Here, F(x,y) may represent the correction value at the sampling position having a horizontal direction coordinate of x and a vertical direction coordinate of y, H(F(x,y)) may be a function outputting a value of 1 when F(x,y) is outside the reference range and a value of 0 when F(x,y) is within the reference range, Vsize may represent a vertical direction number of the plurality of sampling positions, Hsize may represent a horizontal direction number of the plurality of sampling positions, and REF % may represent the reference ratio.

That is, since H(F(x,y)) outputs the value of 1 when the correction value at the sampling position having a coordinate of (x,y) is the overflow correction value outside the reference range, a left-hand side of the equation may correspond to the total number of the overflow correction values. Further, because “Vsize*Hsize” corresponds to the total number of the plurality of sampling positions, or the total number of the plurality of correction values, a right-hand side of the equation may correspond to a reference total number that is the reference ratio of the total number of the plurality of correction values. For example, in a case where REF % is about 0.05%, the frequency criterion may be determined to be satisfied when the total number of the overflow correction values is greater than or equal to about 0.05% of the total number of the plurality of correction values.

In some example embodiments, whether the frequency criterion is satisfied may be determined using a plurality of reference ranges. For example, as illustrated in FIGS. 5 and 7, determining whether the frequency criterion is satisfied (S130) may include determining whether the frequency criterion about the total number of overflow correction values outside a first reference range RR1 corresponding to a default integer portion bit number (e.g., 4 bits) is satisfied (S131), determining whether the frequency criterion about the total number of overflow correction values outside a second reference range RR2 that is twice the first reference range RR1 is satisfied (S132), and determining whether the frequency criterion about the total number of overflow correction values outside a third reference range RR3 that is twice the second reference range RR2 is satisfied (S133).

When the total number of the overflow correction values outside the first reference range RR1 is less than a reference total number (e.g., about 0.05% of the total number of the plurality of correction values) (S131: NO), whether the adjacency criterion is satisfied may be determined (S140), or the bit shift operation may not be performed. For example, as illustrated in FIG. 7, an original correction value 310 on which the bit shift operation is not performed may be stored as correction data having an integer portion bit number of 4 (or a default integer portion bit number) and a decimal portion bit number of 4 (or a default decimal portion bit number). Further, in an example, first through fourth bits B1, B2, B3 and B4 of the correction data may represent a decimal portion of the original correction value 310, fifth through seventh bits B5, B6 and B7 of the correction data may represent an integer portion of the original correction value 310, and an eighth bit of the correction data may be a sign bit BS representing a sign of the original correction value 310.

When the total number of the overflow correction values outside the first reference range RR1 is greater than or equal to the reference total number, and the total number of the overflow correction values outside the second reference range RR2 is less than the reference total number (S131: YES and S132: NO), the bit shift operation may be performed on the plurality of correction values with a shift bit number of 1 (S151). For example, as illustrated in FIG. 7, the bit shift operation may be performed with the shift bit number of 1 such that the second through seventh bits B2 through B7 of the original correction value 310 may become first through sixth bits of a shifted correction value 320, the eighth bit, or the sign bit BS of the original correction value 310 may become a sign bit of the shifted correction value 320, and a ninth bit of the original correction value 310 which is not represented when the bit shift operation is not performed may become a seventh bit of the shifted correction value 320. Accordingly, while, in a case where the bit shift operation is not performed, the correction data has the integer portion bit number of 4 and the decimal portion bit number of 4, and represents a correction value in the first reference range RR1 from about −8 to about +8, in a case where the bit shift operation is performed with the shift bit number of 1, the correction data may have an integer portion bit number of 5 and a decimal portion bit number of 3, and may represent a correction value in the second reference range RR2 from about −16 to about +16.

When the total number of the overflow correction values outside the first reference range RR1 is greater than or equal to the reference total number, the total number of the overflow correction values outside the second reference range RR2 is greater than or equal to the reference total number, and the total number of the overflow correction values outside the third reference range RR3 is less than the reference total number (S131: YES, S132: YES and S133: NO), the bit shift operation may be performed on the plurality of correction values with a shift bit number of 2 (S152). For example, as illustrated in FIG. 7, the bit shift operation may be performed with the shift bit number of 2 such that the third through seventh bits B3 through B7 of the original correction value 310 may become first through fifth bits of a shifted correction value 330, the eighth bit, or the sign bit BS of the original correction value 310 may become a sign bit of the shifted correction value 330, and ninth and tenth bits of the original correction value 310 which are not represented when the bit shift operation is not performed may become sixth and seventh bits of the shifted correction value 330. Accordingly, in a case where the bit shift operation is performed with the shift bit number of 2, the correction data may have an integer portion bit number of 6 and a decimal portion bit number of 2, and may represent a correction value in the third reference range RR2 from about −32 to about +32.

When the total number of the overflow correction values outside the first reference range RR1 is greater than or equal to the reference total number, the total number of the overflow correction values outside the second reference range RR2 is greater than or equal to the reference total number, and the total number of the overflow correction values outside the third reference range RR3 is greater than or equal to the reference total number (S131: YES, S132: YES and S133: YES), the bit shift operation may be performed on the plurality of correction values with a shift bit number of 3 (S153). For example, as illustrated in FIG. 7, the bit shift operation may be performed with the shift bit number of 3 such that the fourth through seventh bits B4 through B7 of the original correction value 310 may become first through fourth bits of a shifted correction value 340, the eighth bit, or the sign bit BS of the original correction value 310 may become a sign bit of the shifted correction value 340, and ninth through eleventh bits of the original correction value 310 which are not represented when the bit shift operation is not performed may become fifth through seventh bits of the shifted correction value 340. Accordingly, in a case where the bit shift operation is performed with the shift bit number of 3, the correction data may have an integer portion bit number of 7 and a decimal portion bit number of 1, and may represent a correction value in the third reference range RR2 from about −64 to about +64.

In some example embodiments, the adjacency criterion may be determined to be satisfied when the number of the overflow correction values at the sampling positions within an adjacent region to the sampling position of any one overflow correction value of the overflow correction values is greater than or equal to a reference adjacent number (S140: YES), and the adjacency criterion may be determined not to be satisfied when the number of the overflow correction values at the sampling positions within the adjacent region is less than the reference adjacent number (S140: NO). For example, the adjacent region may include the sampling position of the any one overflow correction value, and the sampling positions located at top, bottom, right and left of the sampling position of the any one overflow correction value. In some example embodiments, whether the adjacency criterion is satisfied may be determined using an equation "H(F(x,y))+H(F(x,y))*H(F(x,y+1))+H(F(x,y))*H(F(x,y−1))+H(F(x,y))*H(F(x−1,y))+H(F(x,y))*H(F(x+1,y))>=3".

Here, F(x,y) may represent the correction value at the sampling position having a horizontal direction coordinate of x and a vertical direction coordinate of y, and H(F(x,y)) may be a function outputting a value of 1 when F(x,y) is outside the reference range and a value of 0 when F(x,y) is within the reference range.

Thus, when three or more of the correction values at the sampling position and at the top, bottom, right and left of the sampling position are the overflow correction values, the adjacency criterion may be determined to be satisfied. Although the equation uses the reference adjacent number of 3, the reference adjacent number may not be limited to 3. Further, although the equation uses the adjacent region including the sampling position and the top, bottom, right and left of the sampling position, the adjacent region may not be limited thereto. For example, the adjacent region may include 3*3 sampling positions, 5*5 sampling positions, or the like.

In some example embodiments, whether the adjacency criterion is satisfied may be determined using the plurality of reference ranges. For example, as illustrated in FIGS. 6 and 7, determining whether the adjacency criterion is satisfied (S140) may include determining whether the adjacency criterion about the number of adjacent overflow correction values (i.e., the number of overflow correction values within the adjacent region) outside the first reference range RR1 corresponding to the default integer portion bit number (e.g., 4 bits) is satisfied (S141), determining whether the adjacency criterion about the number of adjacent overflow correction values outside the second reference range RR2 that is twice the first reference range RR1 is satisfied (S142), and determining whether the adjacency criterion about the number of adjacent overflow correction values outside the third reference range RR3 that is twice the second reference range RR2 is satisfied (S143).

When the number of the adjacent overflow correction values (i.e., the number of overflow correction values within the adjacent region) outside the first reference range RR1 is less than the reference adjacent number (S141: NO), the bit shift operation may not be performed. For example, as illustrated in FIG. 7, the original correction value 310 on which the bit shift operation is not performed may be stored as the correction data having the integer portion bit number of 4 and the decimal portion bit number of 4.

When the number of the adjacent overflow correction values outside the first reference range RR1 is greater than or equal to the reference adjacent number, and the number of the adjacent overflow correction values outside the second reference range RR2 is less than the reference adjacent number (S141: YES and S142: NO), the bit shift operation may be performed on the plurality of correction values with the shift bit number of 1 (S151). For example, as illustrated in FIG. 7, the bit shift operation may be performed with the shift bit number of 1 such that the original correction value 310 may become the shifted correction value 320.

When the number of the adjacent overflow correction values outside the first reference range RR1 is greater than or equal to the reference adjacent number, the number of the adjacent overflow correction values outside the second reference range RR2 is greater than or equal to the reference adjacent number, and the number of the adjacent overflow correction values outside the third reference range RR3 is less than the reference adjacent number (S141: YES, S142: YES and S143: NO), the bit shift operation may be performed on the plurality of correction values with the shift bit number of 2 (S152). For example, as illustrated in FIG. 7, the bit shift operation may be performed with the shift bit number of 2 such that the original correction value 310 may become the shifted correction value 330.

When the number of the adjacent overflow correction values outside the first reference range RR1 is greater than or equal to the reference adjacent number, the number of the adjacent overflow correction values outside the second reference range RR2 is greater than or equal to the reference adjacent number, and the number of the adjacent overflow correction values outside the third reference range RR3 is greater than or equal to the reference total number (S141: YES, S142: YES and S143: YES), the bit shift operation may be performed on the plurality of correction values with the shift bit number of 3 (S153). For example, as illustrated in FIG. 7, the bit shift operation may be performed with the shift bit number of 3 such that the original correction value 310 may become the shifted correction value 340.

The correction data representing the plurality of correction values on which the bit shift operation is performed, and bit shift information about the bit shift operation may be stored in the display device 200 (S160). In some example embodiments, the bit shift information may represent the shift bit number of the bit shift operation. For example, as illustrated in FIG. 8, the bit shift information having a value of '00' may be stored in the display device 200 when the shift bit number is 0, or when the bit shift operation is not performed. Further, the bit shift information having a value of '01' may be stored in the display device 200 when the bit shift operation is performed with the shift bit number of 1, the bit shift information having a value of '10' may be stored in the display device 200 when the bit shift operation is performed with the shift bit number of 2, and the bit shift information having a value of '11' may be stored in the display device 200 when the bit shift operation is performed with the shift bit number of 3. In some example embodiments, capturing the image displayed by the display device 200 (S110), obtaining the plurality of correction values at the plurality of sampling positions (S120), determining whether the frequency criterion is satisfied (S130), determining whether the adjacency criterion is satisfied (S140), and selectively performing the bit shift operation (S150) may be performed at each of a plurality of reference gray levels. In this case, the correction data and the bit shift information may be stored at each of the plurality of reference gray levels.

In a related art display device, correction data having a fixed integer portion bit number (e.g., 4 bits) and a fixed decimal portion bit number (e.g., 4 bits) are stored. Thus, even if a correction value exceeding a reference range (e.g., from about −8 to about +8) is required, the correction data representing the correction value exceeding the reference range cannot be stored in the related art display device. Accordingly, the related art display device cannot accurately perform mura correction. However, the method of generating the correction data for the display device 200 according to example embodiments may perform the bit shift operation on the plurality of correction values, and may store the correction data suitable for the display device 200. Accordingly, the display device 200 may accurately perform the mura correction based on the correction data suitable for the display device 200. Further, the method of generating the correction data for the display device 200 according to example embodiments may selectively perform the bit shift operation on the plurality of correction values according to whether the frequency criterion and/or the adjacency criterion are satisfied. Accordingly, undesired over-performance and/or non-performance of the bit shift operation caused by a defect of the camera 270 or the like may be prevented or reduced, and desired or optimal correction data suitable for each display device 200 may be generated. Accordingly, the display device 200 may accurately perform the mura correction based on the desired or optimal correction data.

Figure 9A:
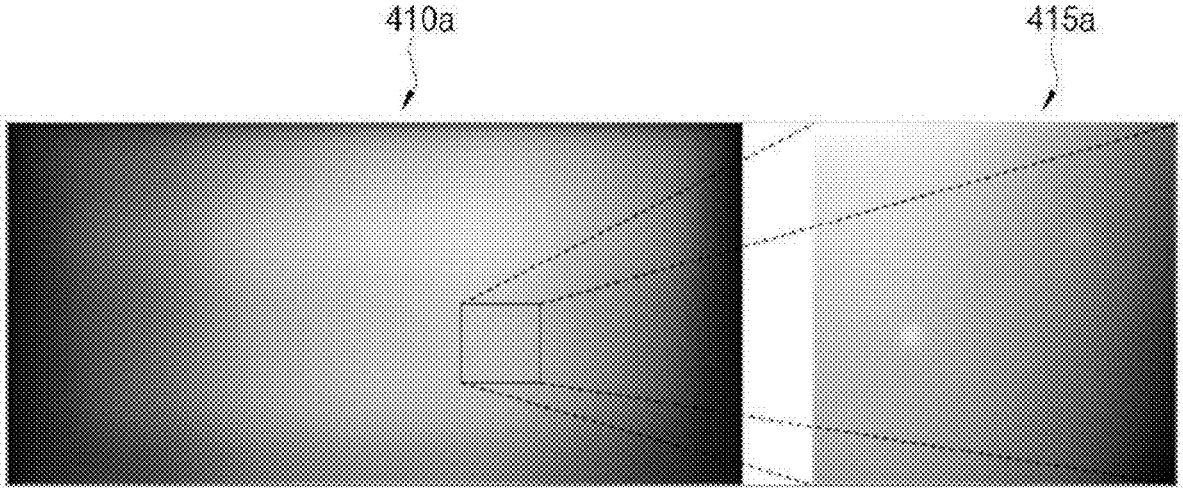
FIG. 9A is a diagram illustrating an example of an image displayed by a display device where a bit shift operation is undesirably performed.
Figure 9B:
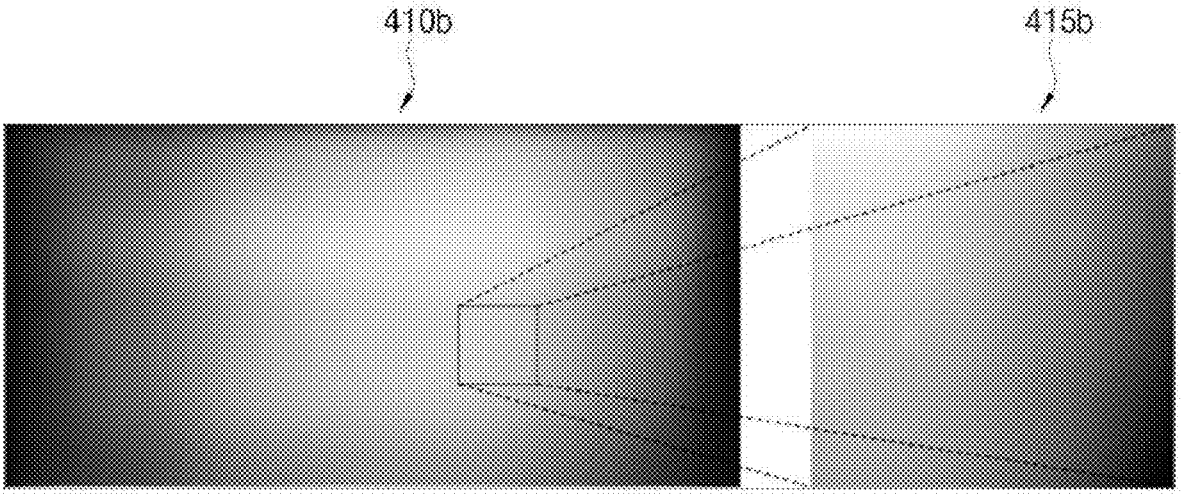
FIG. 9B is a diagram illustrating an example of an image displayed by a display device where a bit shift operation is not performed according to example embodiments.

FIG. 9A is a diagram illustrating an example of an image displayed by a display device where a bit shift operation is undesirably performed, and FIG. 9B is a diagram illustrating an example of an image displayed by a display device where a bit shift operation is not performed according to example embodiments.

A portion of a plurality of correction values may erroneously become overflow correction values due to a camera defect of a test equipment, etc. In this case, a bit shift operation may be undesirably performed on the plurality of correction values. 410*a* in FIG. 9A represents an image of a display device performing mura correction based on correction data representing the plurality of correction values on which the bit shift operation is undesirably performed, and 415*a* in FIG. 9A represents a portion of the image. In a case where the bit shift operation is undesirably performed due to the camera defect, or the like, as illustrated as 415*a* in FIG. 9A, image data at some positions may be excessively corrected, and thus luminance at the some positions may be excessively high or excessively low.

However, in a case where whether a frequency criterion is satisfied may be determined according to example embodiments, even if the portion of the plurality of correction values may erroneously become the overflow correction values due to the camera defect of the test equipment, etc., the frequency criterion may not be satisfied, and thus the bit shift operation for the plurality of correction values may not be performed. In a display device performing the mura correction based on correction data representing the plurality of correction values on which the bit shift operation is not performed because the frequency criterion is not satisfied, the excessive correction for the image data may be prevented or reduced. Thus, as illustrated as an image 410*b* of the display device and a partial image 415*b* in FIG. 9B, the luminance at the some positions may be neither excessively high nor excessively low. As described above, according to example embodiments, the bit shift operation may be selectively performed according to whether the frequency criterion is satisfied, and thus undesired over-performance of the bit shift operation may be prevented or reduced.

Figure 10A:
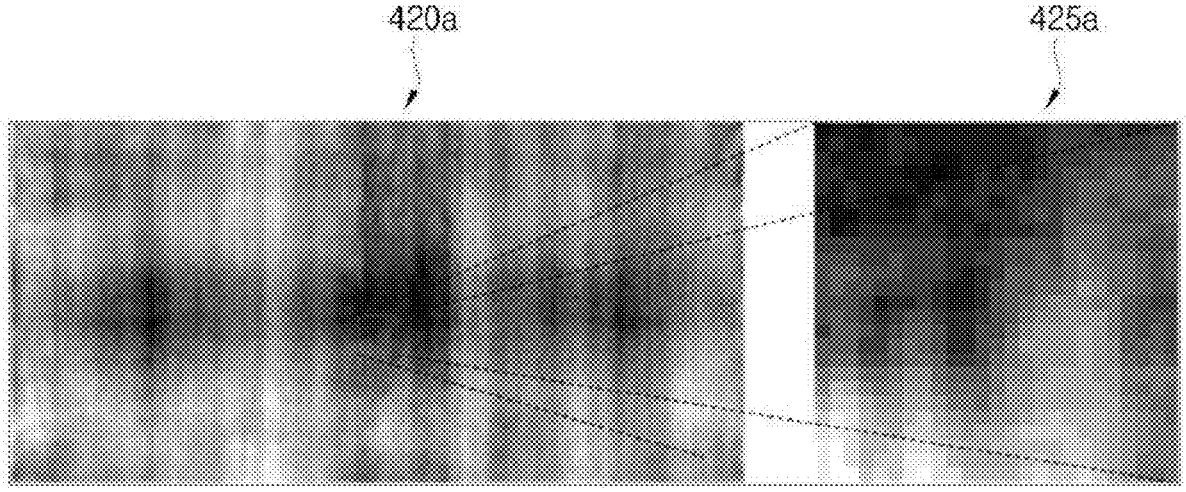
FIG. 10A is a diagram illustrating an example of imaged correction data in a case where a bit shift operation is undesirably performed.
Figure 10B:
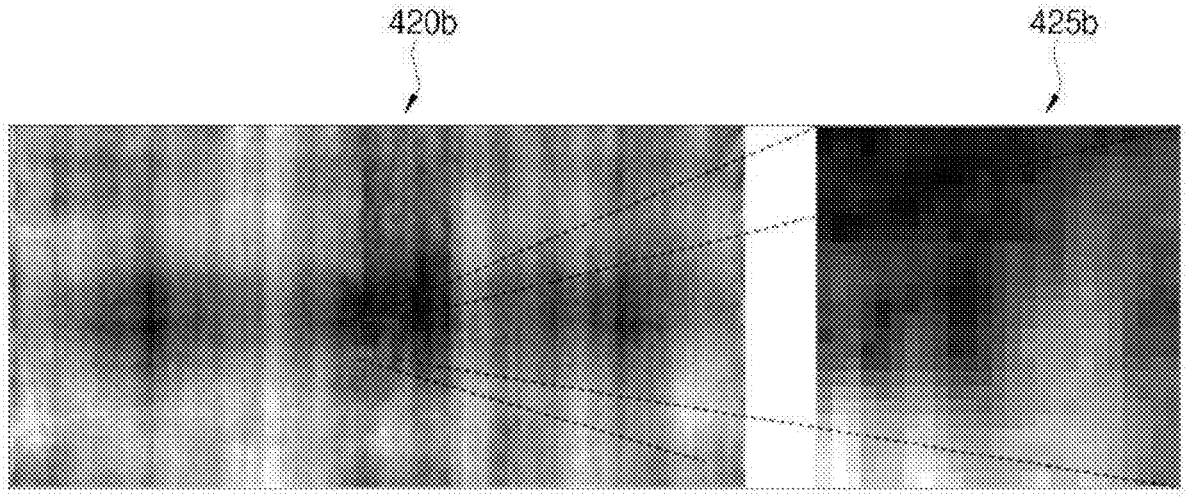
FIG. 10B is a diagram illustrating an example of imaged correction data in a case where a bit shift operation is not performed according to example embodiments.

FIG. 10A is a diagram illustrating an example of imaged correction data in a case where a bit shift operation is undesirably performed, and FIG. 10B is a diagram illustrating an example of imaged correction data in a case where a bit shift operation is not performed according to example embodiments.

420*a* in FIG. 10A represents an image representing a plurality of correction values on which a bit shift operation is undesirably performed due to a camera defect of a test equipment, etc., and 425*a* in FIG. 10A represents a portion of the image. In a case where the bit shift operation is undesirably performed due to the camera defect, or the like, a decimal portion bit number of each correction data may be decreased, and thus the correction data cannot represent a minute correction value. Accordingly, as illustrated as 425*a* in FIG. 10A, the plurality of correction values may have large gaps (or steps).

However, in a case where whether a frequency criterion and/or an adjacency criterion are satisfied may be determined according to example embodiments, even if a portion of the plurality of correction values may erroneously become the overflow correction values due to the camera defect of the test equipment, etc., the frequency criterion and/or the adjacency criterion may not be satisfied, and thus the bit shift operation for the plurality of correction values may not be performed. Thus, the plurality of correction values on which the bit shift operation is not performed because the frequency criterion and the adjacency criterion are not satisfied according to example embodiments may be minutely or minimally represented as an image 430*b* and a partial image 425*b* in FIG. 10B. Accordingly, a display device that stores correction data representing the plurality of correction values may minutely or minimally perform the mura correction. As described above, according to example embodiments, the bit shift operation may be selectively performed according to whether the frequency criterion and/or the adjacency criterion are satisfied, and thus undesired over-performance of the bit shift operation may be prevented or reduced.

Figure 11A:
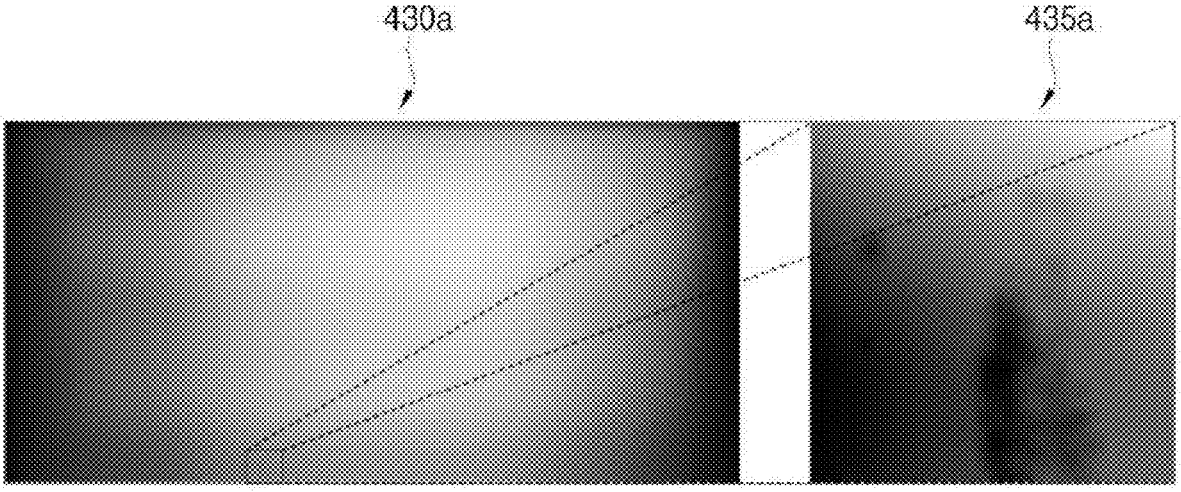
FIG. 11A is a diagram illustrating an example of an image displayed by a display device where a bit shift operation is undesirably performed.
Figure 11B:
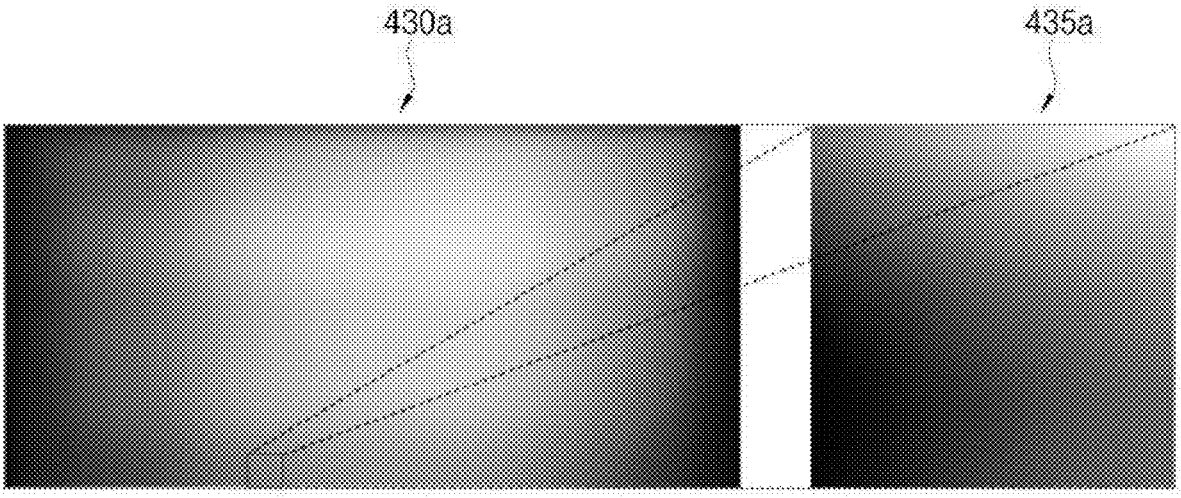
FIG. 11B is a diagram illustrating an example of an image displayed by a display device where a bit shift operation is not performed according to example embodiments.

FIG. 11A is a diagram illustrating an example of an image displayed by a display device where a bit shift operation is undesirably performed, and FIG. 11B is a diagram illustrating an example of an image displayed by a display device where a bit shift operation is not performed according to example embodiments.

In a case where a bit shift operation is selectively performed according to only whether a frequency criterion is satisfied, the bit shift operation may not be performed even if an adjacent mura defect exists, or even if overflow correction values exist in an adjacent region. In this case, in a display device having the adjacent mura defect, but storing correction data representing a plurality of correction values on which the bit shift operation is not performed, mura correction may not be performed to a desired level, and thus the mura defect may be perceived in an image 430*a* and a partial image 435*a* of the display device.

However, in a case where not only whether the frequency criterion is satisfied but also whether an adjacency criterion is satisfied are to be determined, the bit shift operation may be performed if the adjacent mura defect exists, or if the overflow correction values exist in the adjacent region. Accordingly, in a display device storing correction data representing a plurality of correction values on which the bit shift operation is performed, mura correction may be performed to the desired level, and thus the mura defect may not be perceived in an image 430*b* and a partial image 435*b* of the display device. As described above, according to example embodiments, the bit shift operation may be selectively performed according to whether the frequency criterion and the adjacency criterion are satisfied, and thus undesired non-performance of the bit shift operation may be prevented or reduced.

Figure 12:
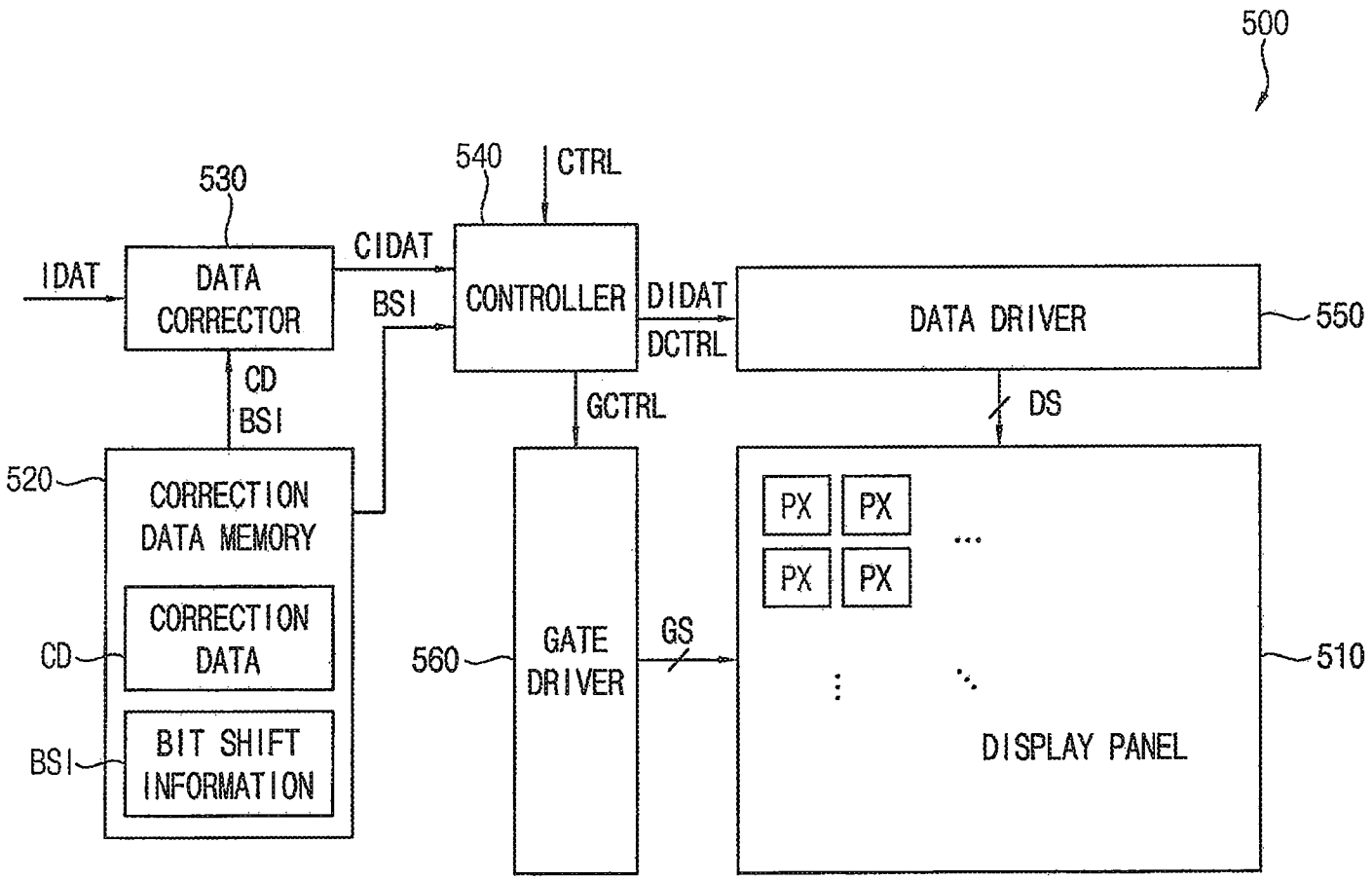
FIG. 12 is a block diagram illustrating a display device according to example embodiments.
Figure 13:
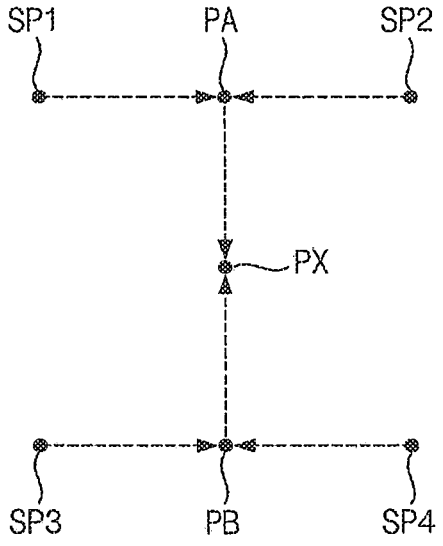
FIG. 13 is a diagram for describing an example of a bilinear interpolation performed by a data corrector included in a display device of FIG. 12.

FIG. 12 is a block diagram illustrating a display device according to example embodiments, and FIG. 13 is a diagram for describing an example of a bilinear interpolation performed by a data corrector included in a display device of FIG. 12.

Referring to FIG. 12, a display device 500 according to example embodiments may include a display panel 510 that includes a plurality of pixels PX, a correction data memory 520 that stores correction data CD and bit shift information BSI, a data corrector 530 that corrects image data IDAT based on the correction data CD and the bit shift information BSI, a data driver 550 that provides data signals DS to the plurality of pixels PX, a gate driver 560 that provides gate signals GS to the plurality of pixels PX, and a controller 540 that controls an operation of the display device 500.

The display panel 510 may include a plurality of data lines, a plurality of gate lines, and the plurality of pixels PX coupled to the plurality of data lines and the plurality of gate lines. In some example embodiments, each pixel PX may include a switching transistor and a liquid crystal capacitor coupled to the switching transistor, and the display panel 510 may be a liquid crystal display (LCD) panel. In other example embodiments, each pixel PX may include an organic light emitting diode (OLED), at least one capacitor and at least two transistors, and the display panel 510 may be an OLED panel. However, the display panel 110 may not be limited to the LCD panel and the OLED panel, and may be any suitable display panel.

The correction data memory 520 may store the correction data CD representing a plurality of correction values on which a bit shift operation is selectively performed according to at least one of whether a frequency criterion is satisfied and whether an adjacency criterion is satisfied, and the bit shift information BSI representing a shift bit number of the bit shift operation. In some example embodiments, before the correction data CD and the bit shift information BSI are written to the correction data memory 520, an image displayed by the display device 500 may be captured, and the plurality of correction values may be obtained at a plurality of sampling positions based on the captured image. When a ratio of the total number of overflow correction values that are the correction values outside a reference range to the total number of the plurality of correction values is greater than or equal to a reference ratio, the frequency criterion may be determined to be satisfied. Further, when the number of the overflow correction values at sampling positions within an adjacent region to a sampling position of any one overflow correction value is greater than or equal to a reference adjacent number, the adjacency criterion may be determined to be satisfied. For example, the adjacent region may include the sampling position of the any one overflow correction value, and the sampling positions located at top, bottom, right and left of the sampling position of the any one overflow correction value.

In some example embodiments, whether the frequency criterion is satisfied may be determined using an equation $$\text{“}\sum_{y=1}^{Vsize}\sum_{x=1}^{Hsize} H(F(x, y)) >= Vsize \times Hsize \times REF\ \%\text{”},$$

where F(x,y) may represent the correction value at a sampling position having a horizontal direction coordinate of x and a vertical direction coordinate of y, H(F(x,y)) may be a function outputting a value of 1 when F(x,y) is outside the reference range and a value of 0 when F(x,y) is within the reference range, Vsize may represent a vertical direction number of a plurality of sampling positions, Hsize may represent a horizontal direction number of the plurality of sampling positions, and REF % may represent the reference ratio. Further, whether the adjacency criterion is satisfied may be determined using an equation “H(F(x,y))+H(F(x,y))*H(F(x,y+1))+H(F(x,y))*H(F(x,y−1))+H(F(x,y))*H(F(x−1,y))+H(F(x,y))*H(F(x+1,y))>=3”, where F(x,y) may represent the correction value at a sampling position having a horizontal direction coordinate of x and a vertical direction coordinate of y, and H(F(x,y)) may be the function outputting a value of 1 when F(x,y) is outside the reference range and a value of 0 when F(x,y) is within the reference range.

In some example embodiments, the correction data CD representing the plurality of correction values on which the bit shift operation is performed may be stored in the correction data memory 520 when either the frequency criterion or the adjacency criterion is satisfied, and the correction data CD representing the plurality of correction values on which the bit shift operation is not performed may be stored in the correction data memory 520 when all of the frequency criterion and the adjacency criterion are not satisfied.

The data corrector 530 may determine an integer portion bit number and a decimal portion bit number of the correction data CD based on the bit shift information BSI, may identify the plurality of correction values represented by the correction data CD based on the determined integer portion bit number and the determined decimal portion bit number, and may generate corrected image data CIDAT by correcting the image data IDAT received from an external host processor (e.g., a graphic processing unit (GPU) or a graphic card) based on the identified plurality of correction values.

For example, when the bit shift information BSI has a value of ‘00’, the data corrector 530 may determine that the bit shift operation is not performed based on the bit shift information BSI having the value of ‘00’, and may determine that each correction data CD has an integer portion bit number of 4 and a decimal portion bit number of 4. In this case, when one correction data CD has a value of ‘01010101’, the data corrector 530 may identify, based on the integer portion bit number of 4 and the decimal portion bit number of 4, that an integer portion of the correction data CD is ‘+5’, a decimal portion of the correction data CD is ‘0.3125’, and the correction data CD represents ‘+5.3125’. Further, based on the correction value of ‘+5.3125’, the data corrector 530 may increase a value of the image data IDAT by the correction value of ‘+5.3125’.

In another example, when the bit shift information BSI has a value of ‘10’, the data corrector 530 may determine that the bit shift operation is performed with a shift bit number of 2 based on the bit shift information BSI having the value of ‘10’, and may determine that each correction data CD has an integer portion bit number of 6 and a decimal portion bit number of 2. In this case, when one correction data CD has a value of ‘01010101’, the data corrector 530 may identify, based on the integer portion bit number of 6 and the decimal portion bit number of 2, that an integer portion of the correction data CD is ‘+21’, a decimal portion of the correction data CD is ‘0.25’, and the correction data CD represents ‘+21.25’. Further, based on the correction value of ‘+21.25’, the data corrector 530 may increase a value of the image data IDAT by the correction value of ‘+21.25’.

In some example embodiments, the correction data CD may represent the plurality of correction values at a plurality of sampling positions, and the data corrector 530 may correct, with respect to each pixel PX, the image data IDAT for the each pixel PX by performing a bilinear interpolation on the plurality of correction values at four sampling positions adjacent to the each pixel PX from among the plurality of sampling positions. For example, as illustrated in FIG. 13, to correct the image data IDAT for the pixel PX, the data corrector 530 may perform the bilinear interpolation on correction values at first through fourth sampling positions SP1, SP2, SP3 and SP4 adjacent to the pixel PX. That is, the data corrector 530 may calculate a correction value at a first intermediate position PA by performing a linear interpolation on the correction values at the first and second sampling positions SP1 and SP2, may calculate a correction value at a second intermediate position PB by performing a linear interpolation on the correction values at the third and fourth sampling positions SP3 and SP4, and may calculate a correction value for the pixel PX by performing a linear interpolation on the correction values at the first and second intermediate positions PA and PB.

Further, in some example embodiments, the correction data CD may be stored at each of a plurality of reference gray levels, and the data corrector 530 may correct, with respect to each pixel PX, the image data IDAT for the each pixel PX by performing a linear interpolation on the plurality of correction values at two reference gray levels adjacent to a gray level of the image data IDAT for the each pixel PX from among the plurality of reference gray levels. According to example embodiments, the linear interpolation between gray levels may be performed after the bilinear interpolation is performed, or may be performed before the bilinear interpolation is performed The controller (e.g., a timing controller; TCON) 540 may receive a control signal CTRL from the external host processor (e.g., the GPU or the graphic card), and may receive the corrected image data CIDAT from the data corrector 530. In some example embodiments, the control signal CTRL may include, but not be limited to, a vertical synchronization signal, a horizontal synchronization signal, an input data enable signal, a master clock signal, etc. The controller 540 may generate a gate control signal GCTRL and a data control signal DCTRL based on the control signal CTRL. Further, the controller 540 may generate dithered image data DIDAT by performing a dithering operation based on the corrected image data CIDAT. In some example embodiments, the controller 540 may perform a spatial dithering operation. For example, when each of the corrected image data CIDAT for respective adjacent four pixels PX has a value of '10.25', the controller 540 may output the dithered image data DIDAT having a value of '10' with respect to three pixels PX of the adjacent four pixels PX, and may output the dithered image data DIDAT having a value of '11' with respect to one pixel PX of the adjacent four pixels PX. In other example embodiments, the controller 540 may perform a temporal dithering operation. For example, when the corrected image data CIDAT for one pixel PX has a value of '10.25' in consecutive four frames, the controller 540 may output the dithered image data DIDAT having a value of '10' with respect to the pixel PX in three frames of the consecutive four frames, and may output the dithered image data DIDAT having a value of '11' with respect to the pixel PX in the remaining one frame of the consecutive four frames. In still other example embodiments, the controller 540 may perform both of the spatial dithering operation and the temporal dithering operation.

In some example embodiments, the controller 540 may determine a dithering bit number of the dithering operation based on the shift bit number represented by the bit shift information BSI, and may perform the dithering operation with the determined dithering bit number. For example, when the bit shift information BSI has the value of '00', because each correction data CD has the decimal portion bit number of 4, the controller 540 may perform the dithering operation with the dithering bit number of 4. In another example, when the bit shift information BSI has the value of '10', because each correction data CD has the decimal portion bit number of 2, the controller 540 may perform the dithering operation with the dithering bit number of 2.

The data driver 550 may generate the data signals DS based on the dithered image data DIDAT and the data control signal DCTRL output from the controller 540, and may provide the data signals DS corresponding to the dithered image data DIDAT to the plurality of pixels PX. For example, the data control signal DCTRL may include, but not be limited to, an output data enable signal, a horizontal start signal and a load signal. In some example embodiments, the data driver 550 may be implemented with one or more data integrated circuits (ICs). Further, according to some example embodiments, the data driver 550 may be mounted directly on the display panel 510, or may be coupled to the display panel 510 in a form of a tape carrier package (TCP). In other example embodiments, the data driver 550 may be integrated in a peripheral portion of the display panel 510.

The gate driver 560 may generate the gate signals GS based on the gate control signal GCTRL from the controller 540, and may provide the gate signals GS to the plurality of pixels PX. In some example embodiments, the gate control signal GCTRL may include, but not be limited to, a frame start signal and a gate clock signal. In some example embodiments, the gate driver 560 may be implemented as an amorphous silicon gate (ASG) driver integrated in the peripheral portion of the display panel 510. In other example embodiments, the gate driver 560 may be implemented with one or more gate ICs. Further, according to some example embodiments, the gate driver 560 may be mounted directly on the display panel 510, or may be coupled to the display panel 510 in the form of the TCP.

As described above, in the correction data memory 520 of the display device 500 according to example embodiments, the correction data CD on which the bit shift operation is selectively performed according to at least one of whether the frequency criterion is satisfied and whether the adjacency criterion is satisfied, and the bit shift information BSI about the bit shift operation may be stored. Accordingly, in the display device 500 according to example embodiments, mura correction may be performed based on the desired or optimal correction data CD suitable for each display device 500.

Figure 14:
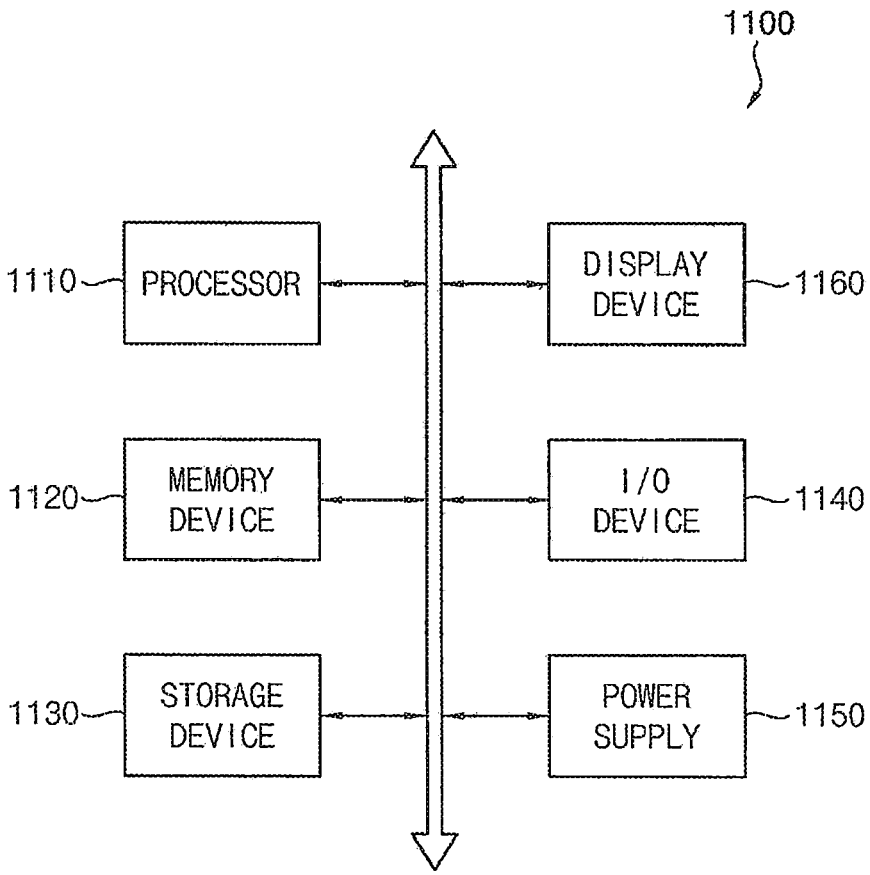
FIG. 14 is a block diagram illustrating an electronic device including a display device according to example embodiments.

FIG. 14 is a block diagram illustrating an electronic device including a display device according to example embodiments.

Referring to FIG. 14, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

The display device 1160 may store correction data on which a bit shift operation is selectively performed according to at least one of whether a frequency criterion is satisfied and whether an adjacency criterion is satisfied, and bit shift information about the bit shift operation, and may correct image data based on the correction data and the bit shift information. Accordingly, mura correction may be performed based on the desired or optimal correction data suitable for each display device 1160.

The inventive concepts may be applied to any display device 1160 performing the mura correction, and any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept."

It will be understood that when an element or layer is referred to as being "on", "coupled to", or "adjacent to" another element or layer, it can be directly on, coupled to, or adjacent to the other element or layer, or one or more intervening elements or layers may be present. In contrast, when an element or layer is referred to as being "directly on," "directly coupled to", or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

As used herein, the terms "use," "using," and "used" may be considered synonymous with the terms "utilize," "utilizing," and "utilized," respectively.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A method of generating correction data for a display device, the method comprising:

capturing an image displayed by the display device;

obtaining a plurality of correction values at a plurality of sampling positions based on the captured image;

determining whether a frequency criterion about a total number of overflow correction values is satisfied, the overflow correction values being the correction values outside at least one reference range;

determining whether an adjacency criterion about a number of the overflow correction values at sampling positions adjacent to a sampling position of the each of the overflow correction values is satisfied with respect to each of the overflow correction values;

selectively performing a bit shift operation on the plurality of correction values according to at least one selected from whether the frequency criterion is satisfied or whether the adjacency criterion is satisfied; and storing correction data representing the plurality of correction values on which the bit shift operation is performed, and bit shift information about the bit shift operation in the display device.

2. The method of claim 1, wherein the determining whether the frequency criterion is satisfied comprises determining the frequency criterion is satisfied when a ratio of the total number of the overflow correction values to a total number of the plurality of correction values is greater than or equal to a reference ratio.

3. The method of claim 1, wherein the determining whether the frequency criterion is satisfied is determined utilizing an equation $$\text{“}\sum_{y=1}^{Vsize}\sum_{x=1}^{Hsize} H(F(x, y)) >= Vsize \times Hsize \times REF\%\text{”},$$

where F(x,y) represents the correction value at the sampling position having a horizontal direction coordinate of x and a vertical direction coordinate of y, H(F(x,y)) outputs a value of 1 when F(x,y) is outside the reference range and a value of 0 when F(x,y) is within the reference range, Vsize represents a vertical direction number of the plurality of sampling positions, Hsize represents a horizontal direction number of the plurality of sampling positions, and REF % represents a reference ratio.

4. The method of claim 1, wherein the determining whether the adjacency criterion is satisfied comprises determining the adjacency criterion is satisfied when the number of the overflow correction values at the sampling positions within an adjacent region to the sampling position of any one overflow correction value of the overflow correction values is greater than or equal to a reference adjacent number.

5. The method of claim 4, wherein the adjacent region comprises the sampling position of the any one overflow correction value, and the sampling positions located at top, bottom, right and left of the sampling position of the any one overflow correction value.

6. The method of claim 1, wherein the determining whether the adjacency criterion is satisfied is determined utilizing an equation "H(F(x,y))+H(F(x,y))*H(F(x,y+1))+H(F(x,y))*H(F(x,y−1))+H(F(x,y))*H(F(x−1,y))+H(F(x,y))*H(F(x+1,y))>=3", where F(x,y) represents the correction value at the sampling position having a horizontal direction coordinate of x and a vertical direction coordinate of y, and H(F(x,y)) outputs a value of 1 when F(x,y) is outside the reference range and a value of 0 when F(x,y) is within the reference range.

7. The method of claim 1, wherein the selectively performing the bit shift operation on the plurality of correction values is performed when the frequency criterion or the adjacency criterion is satisfied, and the selectively performing the bit shift operation on the plurality of correction values is not performed when all of the frequency criterion and the adjacency criterion are not satisfied.

8. The method of claim 1, wherein the at least one reference range comprises a first reference range corresponding to a default integer portion bit number, a second reference range that is twice the first reference range, and a third reference range that is twice the second reference range, wherein the selectively performing the bit shift operation on the plurality of correction values is performed with a shift bit number of 3 when the total number of the overflow correction values outside the third reference range is greater than or equal to a reference total number, wherein the selectively performing the bit shift operation on the plurality of correction values is performed with a shift bit number of 2 when the total number of the overflow correction values outside the second reference range is greater than or equal to the reference total number and the total number of the overflow correction values outside the third reference range is less than the reference total number, wherein the selectively performing the bit shift operation on the plurality of correction values is performed with a shift bit number of 1 when the total number of the overflow correction values outside the first reference range is greater than or equal to the reference total number and the total number of the overflow correction values outside the second reference range is less than the reference total number, and wherein the selectively performing the bit shift operation on the plurality of correction values is not performed when the total number of the overflow correction values outside the first reference range is less than the reference total number.

9. The method of claim 1, wherein the at least one reference range comprises a first reference range corresponding to a default integer portion bit number, a second reference range that is twice the first reference range, and a third reference range that is twice the second reference range, wherein the selectively performing the bit shift operation on the plurality of correction values is performed with a shift bit number of 3 when the number of the overflow correction values outside the third reference range at the sampling positions adjacent to the sampling position of the each of the overflow correction values is greater than or equal to a reference adjacent number, wherein, the selectively performing the bit shift operation on the plurality of correction values is performed with a shift bit number of 2 when the number of the overflow correction values outside the second reference range at the sampling positions adjacent to the sampling position of the each of the overflow correction values is greater than or equal to the reference adjacent number and the number of the overflow correction values outside the third reference range at the sampling positions adjacent to the sampling position of the each of the overflow correction values is less than a reference adjacent number, wherein the selectively performing the bit shift operation on the plurality of correction values is performed with a shift bit number of 1 when the number of the overflow correction values outside the first reference range at the sampling positions adjacent to the sampling position of the each of the overflow correction values is greater than or equal to the reference adjacent number and the number of the overflow correction values outside the second reference range at the sampling positions adjacent to the sampling position of the each of the overflow correction values is less than the reference adjacent number, and wherein the selectively performing the bit shift operation on the plurality of correction values is not performed when the number of the overflow correction values outside the first reference range at the sampling positions adjacent to the sampling position of the each of the overflow correction values is less than the reference adjacent number.

10. The method of claim 1, wherein the bit shift information represents a shift bit number of the bit shift operation.

11. The method of claim 1, wherein the obtaining the plurality of correction values at the plurality of sampling positions, the determining whether the frequency criterion is satisfied, the determining whether the adjacency criterion is satisfied, and the selectively performing the bit shift operation are performed at each of a plurality of reference gray levels, and wherein the correction data and the bit shift information are stored at each of the plurality of reference gray levels.

12. A display device comprising:

a display panel comprising a plurality of pixels;

a correction data memory configured to store correction data representing a plurality of correction values on which a bit shift operation is selectively performed according to at least one of whether a frequency criterion is satisfied and whether an adjacency criterion is satisfied, and bit shift information representing a shift bit number of the bit shift operation;

a data corrector configured to determine an integer portion bit number and a decimal portion bit number of the correction data based on the bit shift information, to identify the plurality of correction values represented by the correction data based on the determined integer portion bit number and the determined decimal portion bit number, and to correct image data based on the identified plurality of correction values;

a controller configured to output dithered image data by performing a dithering operation based on the corrected image data; and a data driver configured to generate data signals based on the dithered image data output from the controller, and to provide the data signals to the pixels.

13. The display device of claim 12, wherein an image displayed by the display device is captured, and the plurality of correction values are obtained at a plurality of sampling positions based on the image, and wherein the display device is configured to determine that the frequency criterion is satisfied when a ratio of a total number of overflow correction values to a total number of the plurality of correction values is greater than or equal to a reference ratio.

14. The display device of claim 13, wherein the display device is configured to determine that the adjacency criterion is satisfied when a number of the overflow correction values at sampling positions within an adjacent region to a sampling position of any one overflow correction value of the overflow correction values is greater than or equal to a reference adjacent number.

15. The display device of claim 14, wherein the adjacent region comprises the sampling position of the any one overflow correction value, and the sampling positions located at top, bottom, right and left of the sampling position of the any one overflow correction value.

16. The display device of claim 12, wherein the display device is configured to determine whether the frequency criterion is satisfied is determined utilizing an equation $$\text{“}\sum_{y=1}^{Vsize}\sum_{x=1}^{Hsize} H(F(x, y)) >= Vsize \times Hsize \times REF\ \%\text{”},$$

where F(x,y) represents the correction value at a sampling position having a horizontal direction coordinate of x and a vertical direction coordinate of y, H(F(x,y)) outputs a value of 1 when F(x,y) is outside a reference range and a value of 0 when F(x,y) is within the reference range, Vsize represents a vertical direction number of a plurality of sampling positions, Hsize represents a horizontal direction number of the plurality of sampling positions, and REF % represents a reference ratio.

17. The display device of claim 12, wherein the display device is configured to determine whether the adjacency criterion is satisfied is determined utilizing an equation “H(F(x,y))+H(F(x,y))*H(F(x,y+1))+H(F(x,y))*H(F(x,y−1))+H(F(x,y))*H(F(x−1,y))+H(F(x,y))*H(F(x+1,y))>=3”, where F(x,y) represents the correction value at a sampling position having a horizontal direction coordinate of x and a vertical direction coordinate of y, and H(F(x,y)) outputs a value of 1 when F(x,y) is outside a reference range and a value of 0 when F(x,y) is within the reference range.

18. The display device of claim 12, wherein the correction data represents the plurality of correction values at a plurality of sampling positions, and wherein the data corrector is configured to correct the image data for each pixel of the plurality of pixels by performing a bilinear interpolation on the plurality of correction values at four sampling positions adjacent to each pixel of the plurality of pixels from among the plurality of sampling positions with respect to each pixel of the plurality of pixels.

19. The display device of claim 12, wherein the correction data memory is configured to store the correction data at each of a plurality of reference gray levels, and wherein the data corrector is configured to correct the image data for each pixel of the plurality of pixels by performing a linear interpolation on the plurality of correction values at two reference gray levels adjacent to a gray level of the image data for each pixel of the plurality of pixels from among the plurality of reference gray levels with respect to each pixel.

20. The display device of claim 12, wherein the controller is configured to determine a dithering bit number of the dithering operation based on the shift bit number represented by the bit shift information, and to perform the dithering operation with the dithering bit number.

* * * * *